United States Patent [19]

Czopor, Jr.

[11] Patent Number: 4,863,022

[45] Date of Patent: Sep. 5, 1989

[54] LEVEL PACKAGE WITH SLEEVE POSITIONING ELEMENT

[75] Inventor: Edmund J. Czopor, Jr., Burlington, Conn.

[73] Assignee: The Stanley Works, New Britain, Conn.

[21] Appl. No.: 327,682

[22] Filed: Mar. 23, 1989

[51] Int. Cl.[4] ..... B65D 85/38; B65D 5/02

[52] U.S. Cl. ..... 206/349; 206/371; 206/45.14; 206/45.31

[58] Field of Search ..... 206/45.14, 45.15, 45.31, 206/45.33, 349, 371, 482

[56] References Cited

U.S. PATENT DOCUMENTS

| | | | |
|---|---|---|---|
| 1,899,547 | 2/1933 | Addis et al. . | |
| 3,077,978 | 2/1963 | Krzyzanowski et al. | 229/162 |
| 3,785,478 | 1/1974 | Drori | 206/45.31 |
| 3,853,741 | 12/1974 | Klupt . | |
| 3,927,765 | 12/1975 | Beal . | |
| 4,106,615 | 8/1978 | Hiroshi . | |
| 4,662,512 | 5/1987 | Durand . | |
| 4,754,873 | 7/1988 | Rawlings et al. . | |

*Primary Examiner*—Stephen Marcus
*Assistant Examiner*—Jacob K. Ackun, Jr.

[57] ABSTRACT

A level display assembly includes a level with an elongated body having a hand hole along the length thereof and at least one level indicator mounted thereon. Extending about the body of the level is an elongated tubular sleeve which has a hinged flap formed along its length. The flap has its free end extending into and engaged with the level about the hand hole to limit relative sliding motion therebetween. The sleeve may also have apertures therein aligned with the level indicators disposed thereunder to permit viewing of the indicators therethrough. The sleeve is formed from a unitary blank with a series of fold lines which allow it to be formed into a rectangular cross section, and the flap is hinged along one of the fold lines. The material from which the sleeve is formed provides sufficient resilient deflectability to permit the flap to be pulled through the hand hole to abut the opposite surface thereof.

12 Claims, 2 Drawing Sheets

LEVEL PACKAGE WITH SLEEVE POSITIONING ELEMENT

BACKGROUND OF THE INVENTION

The present invention relates to packages containing levels, and, more particularly, to a package comprising an elongated level with a packaging sleeve encircling a portion of its length.

Elongated levels have long been employed by artisans and handymen alike for many applications. Displaying such elongated levels at a hardware store or similar establishment dealing in the levels frequently presents a problem because of the necessity for enabling visual examination of the level by the prospective buyer. At the same time, it is desirable to identify the characteristics of the level and the manufacturer and to provide various promotional information which would encourage the buyer to purchase the particular product.

Encasing the entire rule in an elongated carton adds substantial cost and limits the opportunity for inspection unless the carton is opened or unless windows of substantial size are provided. Simply providing a plastic bag with a printed header limits the amount of information which the manufacturer can include on the header card. Providing one or more paperboard bands about the product and imprinted with product information presents problems for assembly and maintaining the bands in place. Similarly, elongated packaging sleeves of paperboard or the like, while providing a substantial area for manufacturer information, tend to obscure the portions of the level thereunder and also tend to slide along the length of the level so as to become separated therefrom.

It is an object of the present invention to provide a novel level display assembly including a sleeve which may be secured in a position along the length of the level.

It is also an object to provide such a level display assembly in which level indicators underlying the sleeve may be inspected.

Another object is to provide such a level display assembly which may be simply and economically fabricated and assembled and in which the sleeve may be readily removed by the purchaser.

SUMMARY OF THE INVENTION

It has now been found that the foregoing and related objects and advantages may be readily attained in a level display assembly which includes a level having an elongated body with at least one hand hole along the length thereof and at least one level indicator mounted on the body adjacent the one hand hole. Extending about the level at the one hand hole is an elongated tubular sleeve of rectangular cross section. The sleeve is dimensioned to receive the level for sliding movement relative thereto, and it has a hinged flap formed therein. The free end of the flap extends into and is engaged with the level about the one hand hole to limit relative sliding motion and thereby it positions the sleeve on the level. However, the free end of the flap is pivotable into a position outwardly of the hand hole to permit the sleeve to be slid along the level to an end thereof to effect its removal.

Preferably, the sleeve has at least one aperture therein aligned with the one indicator to permit viewing of the indicator therethrough, and desirably it has a second aperture therein in its face opposite the one aperture to permit viewing of the indicator through both faces of the sleeve. Generally, the sleeve is provided by a unitary element of paperboard or the like which is folded into a rectangular cross section, and the flap is hinged along one of the fold lines.

The level may be of generally rectangular cross section and the sleeve snugly receives the level. The level may also have a generally I-shaped cross section defined by a pair of legs and a connecting web with the level indicator and hand hole being disposed in the web.

Preferably, the free end of the flap extends through the hand hole and has portions which abut the opposite surface of the web of the level. To do so, the flap is resiliently deflectable to permit the free end to be pushed through the hand hole to abut the opposite surface.

BRIEF DESCRIPTION OF THE INVENTION

DETAILED DESCRIPTION OF PREFERRED EMBODIMENT OF THE INVENTION

Turning first to FIGS. 1–4, a package embodying the present invention has an elongated level generally designated by the numeral 10 and a sleeve generally designated by the numeral 12 which extends about a portion of the length thereof.

Figure 3:
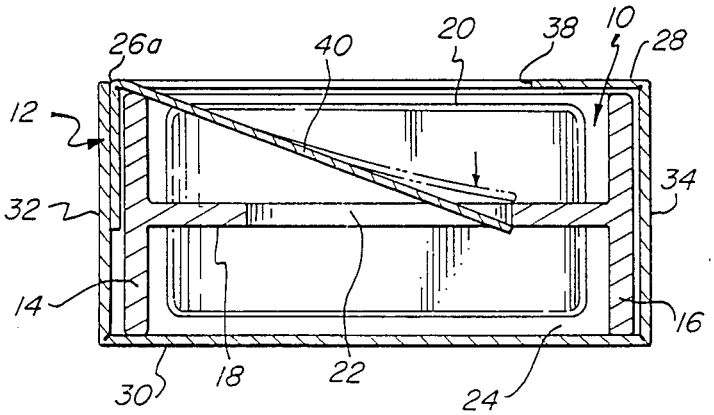
FIG. 3 is a sectional view along the line 3—3 of FIG. 2 and drawn to a further enlarged scale.
Figure 8:
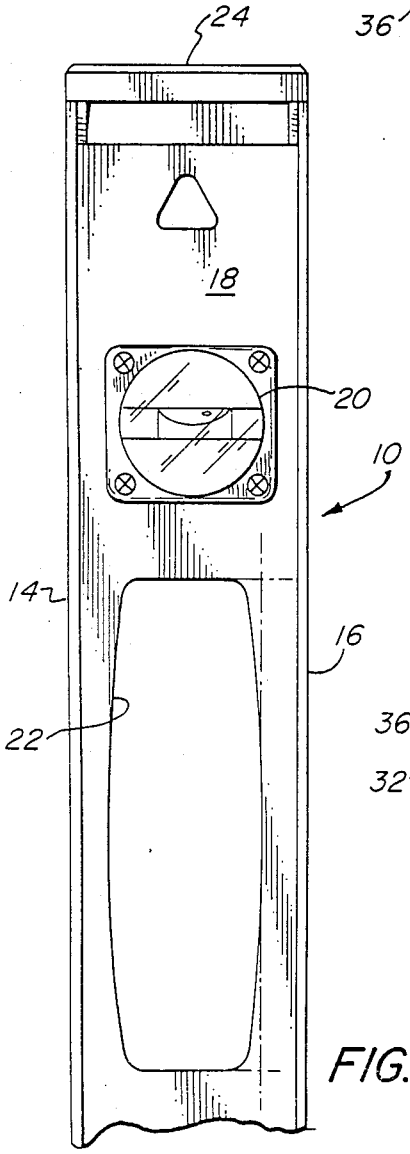
FIG. 8 is a top plan view of the level of FIG. 1.

As best seen in FIGS. 3 and 8, the level 10 has an elongated body of generally I-shaped cross section defined by the arms 14, 16 and the web 18. Disposed in apertures in the web 18 are level vial indicator units 20 (only one is shown), and the web 18 also has hand holes 22 therein (only one is shown). To protect the body of the level 10 against shocks, end caps 24 are fitted over the ends thereof.

Figure 7:
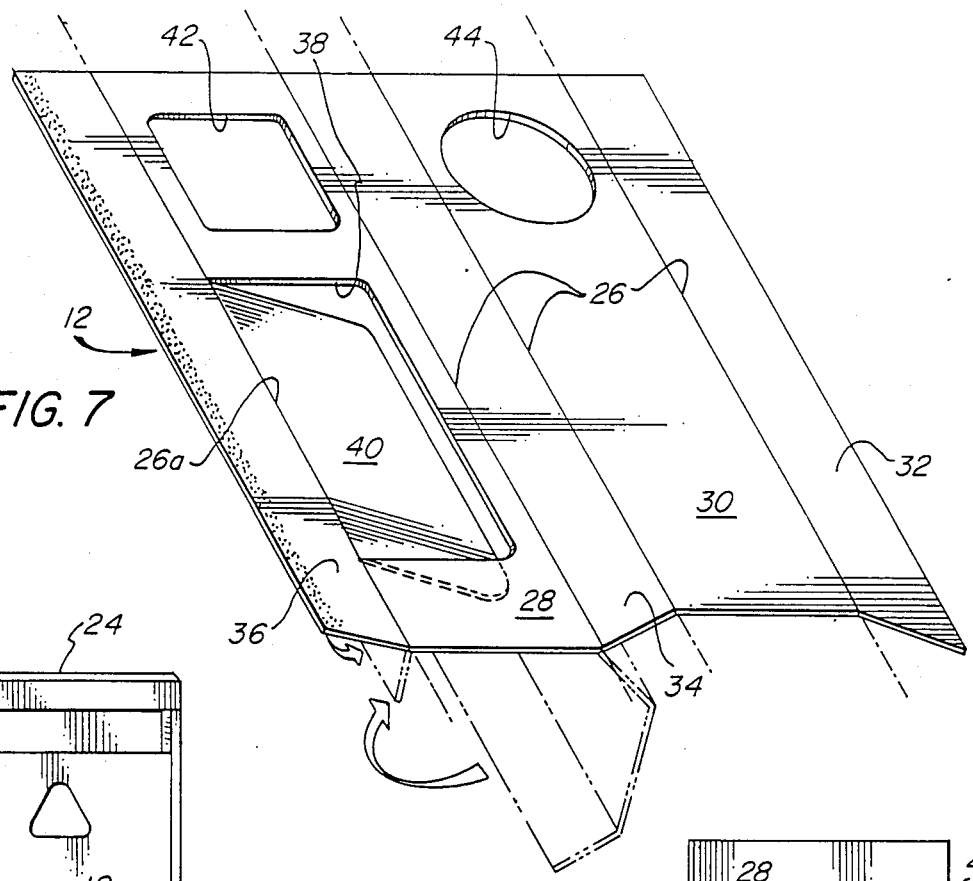
FIG. 7 is a view in solid line of the unfolded blank for the sleeve and showing in phantom line portions of the blank in partially folded position.
Figure 6:
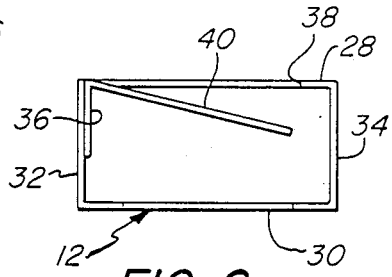
FIG. 6 is an end elevational view thereof with the flap pushed downwardly.
Figure 5:
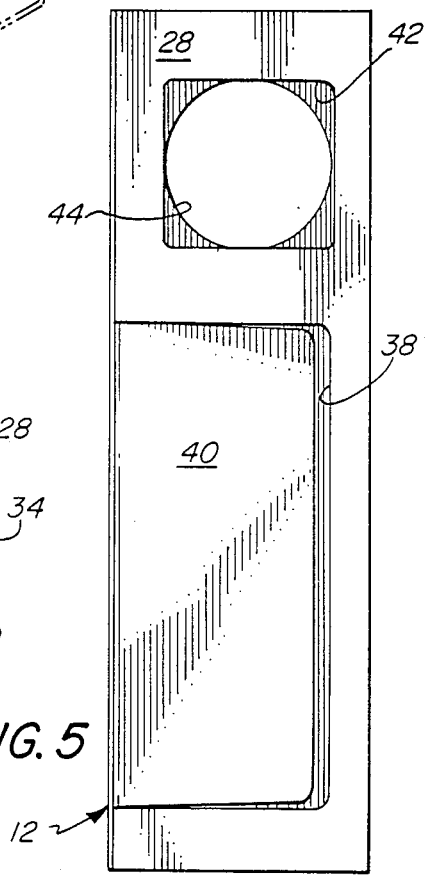
FIG. 5 is a top plan view of the sleeve.

As seen in FIGS. 5–7, the elongated sleeve 12 is of folded paperboard construction with a series of spaced longitudinal fold line 26 allowing it to be formed into a rectangular cross section with top and bottom panels 28, 30, end panels 32, 34, and a glue flap 36 which is bonded to the end panel 32 to secure the sleeve 12 in its folded rectangular configuration. The top panel 28 has a U-shaped slit 38 therein which forms a flap 40 hinged along the fold line 26a. The top panel 28 also has a rectangular cut out 42, and the bottom panel 30 has a circular cutout 44 aligned therewith.

Figure 1:
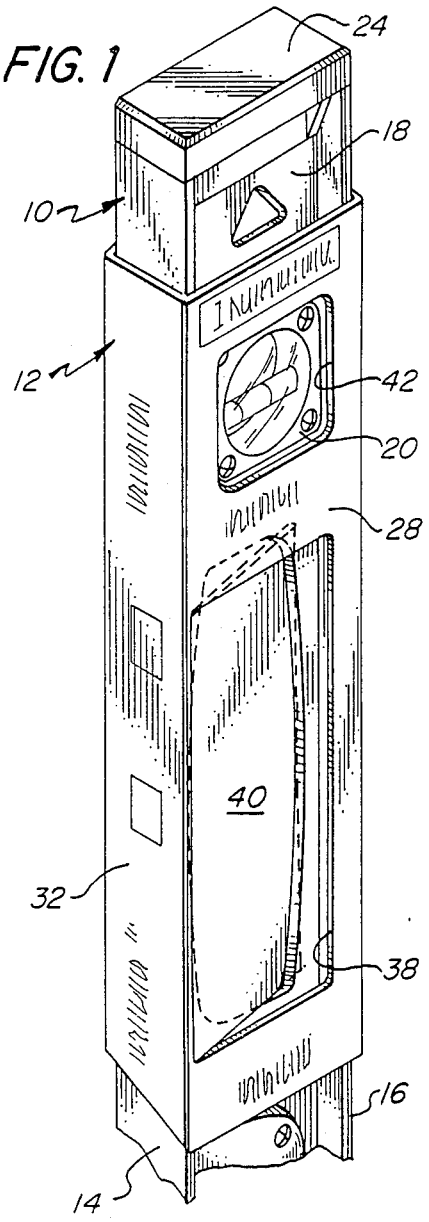
FIG. 1 is a fragmentary perspective view of a level package embodying the present invention.
Figure 2:
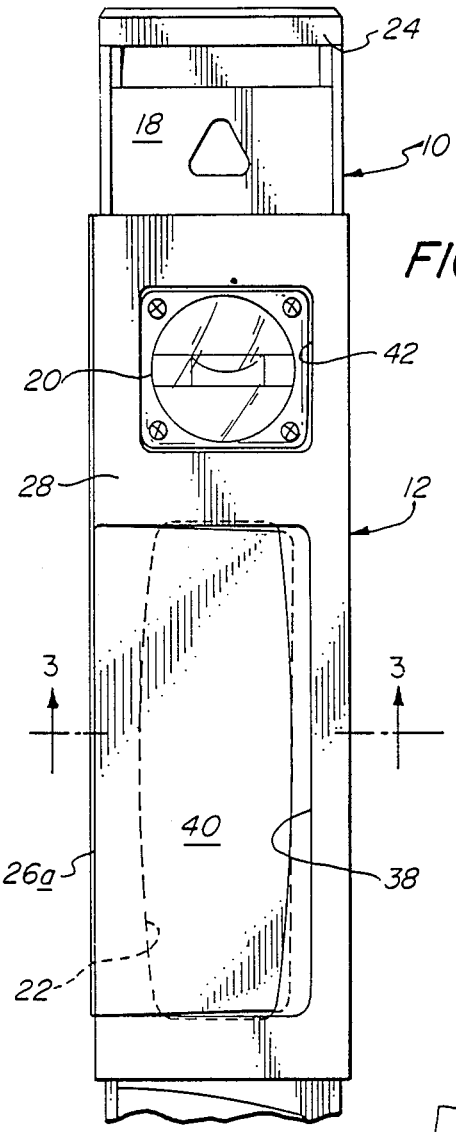
FIG. 2 is a fragmentary top plan view thereof drawn to a slightly enlarged scale.
Figure 4:
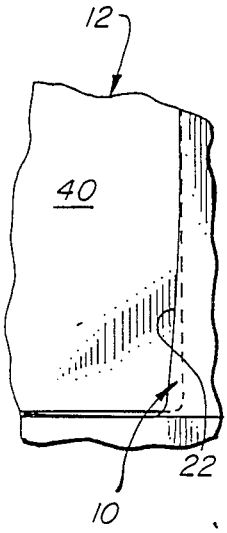
FIG. 4 is a fragmentary top plan view of the flap and hand hole portion of the level package.

In assembly, the sleeve 12 is slid onto and along the level 10 until the cutouts 42, 44 are aligned with the level vial indicator unit 20 and the flap 40 is aligned with the hand hole 22. The flap 40 is then pushed downwardly to pass it through the hand hole 22 by causing the end portions thereof adjacent its free end to deflect resiliently to enable them to pass through the reduced width end portions of the hand hole 22, as seen in FIGS. 2–4. As a result, the end portions of the flap 40 adjacent the free end thereof abut and resiliently bear upon the opposite or lower surface of the web 18.

As will be readily appreciated, the package of the present invention may be used with levels of various constructions. One form of level has an elongated body of solid wood or plastic with cutouts for mounting the level indicators and to provide one or more hand holes. Thus, its cross section is essentially rectangular. In some instances, the wooden body has metal strips extending along the edges thereof to protect its edges from injury occurring due to impacts.

In another style, the body is fabricated from an aluminum or other metallic extrusion of generally I-shaped cross section with holes formed along its length for mounting the level indicators and to provide hand holes for manipulating the level. Various other types of body structures have been proposed but generally the outline defined by the two sides of the level is of rectangular nature.

Most elongated levels will have more than one hand hole and all will have a series of level indicators disposed in various angular relationships.

Although the sleeve could extend over the full length of the level, generally a limited length of about 4 to 16 inches will be sufficient to permit the provision of the necessary information concerning the product and promotional material to attract the user, thus enabling the bulk of the length of the level to be exposed to view. If long sleeves are employed, then it is desirable to employ more than one cutout for the level indicators so that all of them may be readily viewed. It would also be possible to incorporate more than one flap to cooperate with multiple hand holes covered thereby.

Generally, the sleeves will be formed from paperboard; however, laminates of paperboard with plastic and with foil may also be employed. It is also possible to fold plastic sheeting into a rectangular structure of the defined configuration. Alternatively, synthetic resin may be extruded into a rectangular tube and then provided with the necessary cutouts and imprinting. From the standpoint of cost and ease of assembly, paperboard is preferred since the paperboard may be readily printed, folded and then glued into the rectangular configuration.

With respect to the illustrated embodiment, the flap may be readily disengaged from the hand hole by pushing down upon the flap adjacent its fold line to spring the free end outwardly of the handle, or by catching an end of the flap with a finger and lifting it upwardly.

Thus, it can be seen from the foregoing detailed description and the accompanying drawings that the level display package of the present invention is one which may be readily fabricated and assembled, and in which the sleeve is positioned reasonably securely in a fixed position along the length of the level for display purposes. The sleeve may contain such cutouts as are necessary to expose underlying portions of the level for viewing.

Having thus described the invention, what is claimed is:

1. A level display assembly comprising:

(a) a level having an elongated body with at least one hand hole along the length thereof and at least one level indicator mounted on said body adjacent said one hand hole; and (b) an elongated tubular sleeve extending about said level at said one hand hole, said sleeve being of rectangular cross section and being dimensioned to receive said level for sliding movement relative thereto, said sleeve having a hinged flap formed thereon with its free end extending into and engaged with the level about said one hand hole to limit relative sliding motion and thereby position said sleeve on said level, the free end of said flap being pivotable into a position outwardly of said hand hole to permit said sleeve to be slid along said level to an end thereof to effect its removal.

2. The level display assembly of claim 1 wherein said sleeve has at least one aperture therein aligned with said one indicator to permit viewing of said indicator therethrough.

3. The level display assembly of claim 2 wherein said sleeve has a second aperture therein opposite said one aperture to permit viewing of said indicator through both faces of said sleeve.

4. The level display assembly of claim 1 wherein said level is of generally rectangular cross section and said sleeve snugly receives said level.

5. The level display assembly of claim 1 wherein said sleeve is provided by a unitary element folded into a rectangular cross section and wherein said flap is hinged along one of the fold lines.

6. The level display assembly of claim 1 wherein said level has a generally I-shaped cross section defined by a pair of legs and a connecting web, said level indicator and hand hole being disposed in said web.

7. The level display assembly of claim 6 wherein said sleeve has first and second apertures aligned with said level indicator to permit viewing of said indicator through both faces of said sleeve and wherein said free end of said flap extends through said hand hole and has portions which abuts the opposite surface of the web of said level.

8. The level display assembly of claim 7 wherein said flap is resiliently deflectable to permit said free end to be pushed through said hand hole to abut said opposite surface.

9. A level display assembly comprising:

(a) a level having an elongated body with at least one hand hole along the length thereof and at least one level indicator mounted on said body adjacent said one hand hole; and (b) an elongated tubular sleeve extending about said level at said one hand hole, said sleeve being of rectangular cross section and being dimensioned to receive said level for sliding movement relative thereto, said sleeve having a hinged flap formed thereon with its free end extending into and engaged with the level about said one hand hole to limit relative sliding motion and thereby position said sleeve on said level, said sleeve also having at least one aperture therein aligned with said one indicator to permit viwing of said indicator therethrough, said sleeve being a unitary element folded into a rectangular cross section, said flap being hinged along one of the fold lines and said flap being resiliently deflectable to permit said free end to be pushed through said hand hole to abut said opposite surface, the free end of said flap being pivotable into a position outwardly of said hand hole to permit said sleeve to be slid along said level to an end thereof to effect its removal.

10. The level display assembly of claim 9 wherein said sleeve has a second aperture therein opposite said one aperture to permit viewing of said indicator through both faces of said sleeve.

11. The level display assembly of claim 9 wherein said level has a generally I-shaped cross section defined by a pair of legs and a connecting web, said level indicator and hand hole being disposed in said web.

12. The level display assembly of claim 11 wherein said sleeve has first and second apertures aligned with said level indictor to permit viewing of said indicator through both faces of said sleeve and wherein said free end of said flap extends through said hand hole and has portions which abut the opposite surface of the web of said level.

* * * * *